US011512926B2

(12) United States Patent
Haimi

(10) Patent No.: US 11,512,926 B2
(45) Date of Patent: Nov. 29, 2022

(54) WRIST BAND DEVICE FOR RELEASING HOLSTER LOCK

(71) Applicant: LOCKING CONTROL LTD., Or Akiva (IL)

(72) Inventor: Shlomo Uri Haimi, Or Akiva (IL)

(73) Assignee: LOCKING CONTROL LTD., Or Akiva (IL)

( * ) Notice: Subject to any disclaimer, the term of this patent is extended or adjusted under 35 U.S.C. 154(b) by 137 days.

(21) Appl. No.: 17/178,343

(22) Filed: Feb. 18, 2021

(65) Prior Publication Data

US 2022/0260337 A1 Aug. 18, 2022

(51) Int. Cl.

| | |
|---|---|
| ***F41C 33/02*** | (2006.01) |
| ***F41A 17/06*** | (2006.01) |
| ***F41A 17/54*** | (2006.01) |

(52) U.S. Cl.

CPC ..... *F41C 33/0263* (2013.01); *F41A 17/063* (2013.01); *F41A 17/54* (2013.01); *F41C 33/029* (2013.01); *F41C 33/0227* (2013.01)

(58) Field of Classification Search

CPC ..... F41C 33/0263; F41C 33/0227; F41C 33/029; F41A 17/54; F41A 17/063

See application file for complete search history.

(56) References Cited

U.S. PATENT DOCUMENTS 3,939,679 A * 2/1976 Barker ..... F41A 17/063 341/181
5,828,301 A * 10/1998 Sanchez ..... F41C 33/029 340/568.1
6,799,726 B2 * 10/2004 Stockhammer ..... G07C 9/10 235/382
8,127,482 B2 * 3/2012 O'Shaughnessy .... F41A 17/063 42/70.11
2002/0032976 A1 * 3/2002 Riener ..... F41A 17/063 42/70.11
2003/0070343 A1 * 4/2003 Glock ..... F41A 17/063 42/70.11
2003/0103414 A1 * 6/2003 Lyon ..... H04W 12/33 368/10
2003/0174049 A1 * 9/2003 Beigel ..... G06K 19/0723 340/5.61
2008/0244699 A1 * 10/2008 Parhofer ..... G07C 9/37 726/2
2017/0163942 A1 * 6/2017 Teetzel ..... F41A 17/063
2019/0295700 A1 * 9/2019 Weinstock ..... G16H 40/20
2022/0214124 A1 * 7/2022 Leonhardt ..... F41A 19/01

* cited by examiner

*Primary Examiner* — Joshua E Freeman
(74) *Attorney, Agent, or Firm* — Mark M. Friedman

(57) ABSTRACT

A wrist device for unlocking a safety holster for use with a weapon, the holster includes an electronically actuated locking mechanism configured to admit the weapon into the safety holster, and to lock the holster, thereby preventing the withdrawal of the weapon prior to release of the electronically actuated locking mechanism upon receipt of an unlock signal, the wrist device including: a wearable band, adapted to be worn on a forearm; a sensing mechanism operationally coupled to the wearable band and adapted to be actuated as a result of a predefined actuation movement of a hand or forearm wearing the wrist device; a wireless communications component configured to send the unlock signal when the sensing mechanism is actuated; and a processing unit in electrical communication with the sensing mechanism and the wireless communications component.

16 Claims, 13 Drawing Sheets

PRIOR ART
Fig. 11E Handle-end View
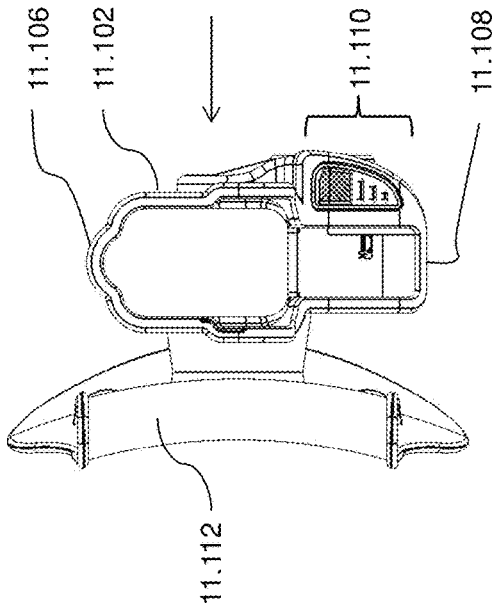
Fig. 11F Muzzle-end View
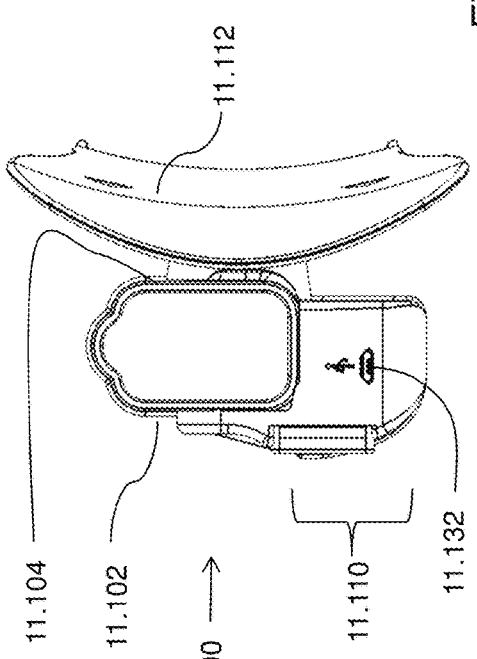
Fig. 11G Top View
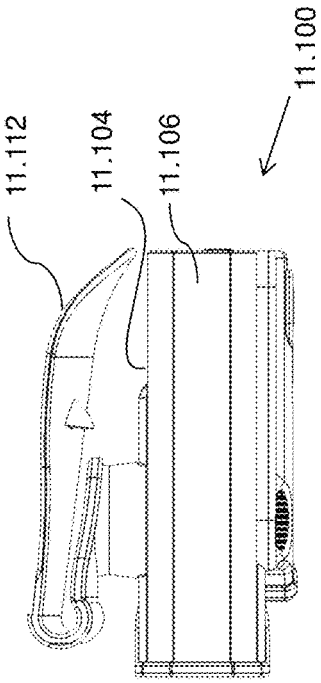
Fig. 11H
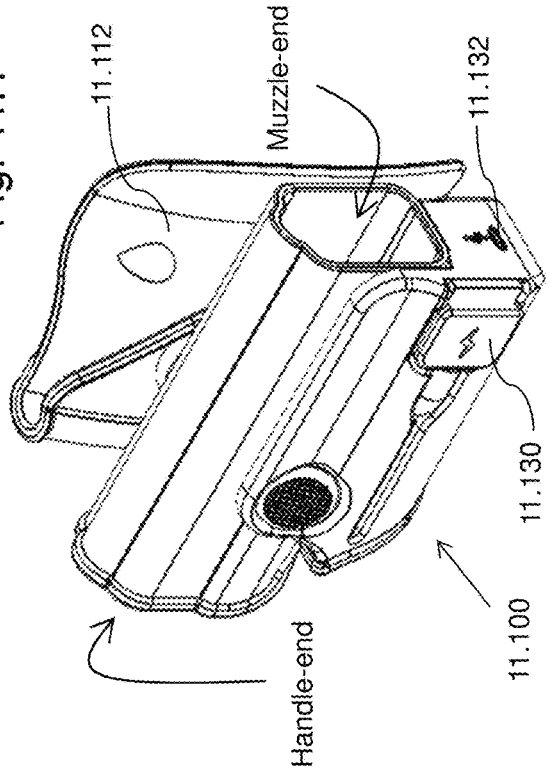

WRIST BAND DEVICE FOR RELEASING HOLSTER LOCK

FIELD OF THE INVENTION

The present invention relates to a weapon safety and, more particularly, to a device and method for locking and unlocking a weapon holster, using a wrist worn device.

BACKGROUND OF THE INVENTION

There are countless incidents in which unauthorized people, especially young children, manage to obtain firearms, often unintentionally (or intentionally) discharging the firearm. This type of occurrence is very prevalent in the home setting and causes many cases of harm to human life and wellbeing. Gun carrying individuals with non-concealed weapons always run the risk of having their weapon snatched from its holster.

Holsters for restraining a gun inside the holster are known in the art. U.S. Pat. No. 9,784,515, which is incorporated in its entirety as if fully set forth herein, describes one such holster.

DEFINITIONS

Short-Range/Local Wireless Technology

A plethora of wireless technologies exist today. Many of those technologies have only a short working range. Bluetooth, WiFi, RFID and NFC are a small sampling of the short-range wireless technologies. Most mobile phones and portable computing devices include at least one, and sometimes two, three or more, short-range wireless technologies.

A number of exemplary short-range technologies and their approximate transmission/communication ranges follow. Bluetooth technology transmits up to approximately 30 meters or 100 feet. RFID technology has a number of different ranges, depending on various factors. Typically, the read range is approximately between 3 and 300 feet (1-100 meters). RFID readers can read tags in smart cards from about 3 feet; tags on pallets and cases of goods can be read from approximately 20-30 feet and battery-powered tags (e.g. tags used in toll collection) up to approximately 300 feet. NFC technology can typically transmit data over a distance/range of between 4 cm and 1.2 m.

Wired Technology

Almost all mobile devices and portable computing devices include a data port that can be used to connect the device to another computer. For example, laptops include one or more USB ports, Apple® devices (e.g. iPhone™, iPad™, etc.) have specialized data ports, Android™ devices (smartphones, tablets etc.) usually include mini-USB or micro-USB ports. The data ports allow the mobile phone or portable computing device to connect to other devices for the purpose of one- or two-way data communication/transfer. Data ports, docking ports, USB cables and connectors are generally capable of transferring power in addition to data. For example, a smartphone connected to a laptop not only allows for transfer of data between the devices but in many cases the laptop also charges the smartphone battery at the same time.

The terms "mobile device", "mobile communications device", "mobile phones", "handsets" and similar variations refer herein generally to a cellular phone, and in some embodiments, refer to a cellular phone enabled with either GPS capabilities or similar satellite-based positioning capabilities that can pin-point the X and Y coordinates or X, Y and Z coordinates of the device. Global Navigation Satellite System (GNSS) receivers, using the GPS, GLONASS, Galileo or Beidou system, are used in many applications. For simplicity sake, the terms "GPS" or "GPS-like" will be used in this document but it is to be understood that this is only an exemplary reference. The GPS device may either be integrated into the mobile handset or an external device coupled (wired or wireless) to the handset.

'Mobile device', 'smart phone', 'cell-phone', 'cellular device' and similar terms are used interchangeably here, generally referring to a mobile handset with at least celluar telephonic communications capabilities, computing capabilities, as well as wireless local/short-range data communication capabilities (e.g. Bluetooth™, RFID, NFC etc.), unless otherwise specified. Mobile devices having the aforementioned capabilities are commonly referred to as smartphones. In some embodiments, the mobile devices also include GPS-like technology. The current invention pertains equally to mobile/portable computing platforms having the same capabilities, even those not generally used for telephonic communications (e.g. PDAs) or even lacking such features (e.g. tablet or laptop computers etc.).

Portable/Mobile Computing Device Not Limitive

The present invention anticipates a wide variety of applications for the remotely activated gun and utility locks taught herein. Within the application context, the term "portable computing device", "mobile computing device", "mobile device" and variants thereof should be given the broadest possible interpretation, to include but not be limited to laptop computers, cellphones, smart phones, tablet computers, mini tablets and other like and typical applications where computing devices are configured in a portable or semi-portable manner. While the present invention anticipates that the computational capability of the "computing device" described herein may vary widely, it is anticipated that some aspects of the present invention may be implemented using software embodied in computer readable program code means embodied on a tangible medium that is computer readable.

Wearable technology is also considered to be within the meaning of portable computing devices. Wearable technology, wearable devices, tech togs, or fashion electronics are clothing and accessories incorporating computer and advanced electronic technologies. Of special mention are wrist-worn devices and devices worn of the forearm. The designs often incorporate practical functions and features but may also have a purely critical or aesthetic agenda. One well known wearable technology is Google Glass™. Google Glass is a wearable computer with an optical head-mounted display (OHMD) that is being developed by Google, headquarted in Mountain View, Calif., U.S. Another well-known product line of wearable computing devices is the Samsung Gear™ line of products produced by Samsung Electronics, Suwon, Gyeonggi Province, South Korea. Samsung Gear products include the Android Smartwatch which is a computerized wristwatch. Some advanced smartwatches have technological capabilities similar to those of smartphones.

Computing Device Not Limitive

The present invention may make use of a wide variety of computing devices in its general theme of construction. While microcontroller unit (MCU) construction may be optimal in many circumstances, the present invention is not limited to this particular form of construction and the term "computing device" and "MCU" should be given their broadest possible definitions in this context. The terms processing unit, processor and central processing unit (CPU) are used interchangeably with the term microcontroller.

Weapon Not Being Limitive

The present invention anticipates a wide variety of safety holsters for weapons. The term 'weapon' is used herein to refer to both lethal and non-lethal devices including, but are not limited to: guns (any firearm that can be holstered), Tasers®, batons, pepper spray and stabbing weapons (e.g., a knife). The terms 'firearm', 'handgun', 'gun' and variations of the same are mentioned numerous times in the disclosure. These term are used interchangeably and are not intended to be limiting in any way. Any time reference is made to a specific type of weapon, it is hereby made clear that the term used is exemplary and intended to include all other types of weapons that can be carried in a holster.

Anatomical Terminology

The wrist and forearm are referred to herein and anatomical ternimology that is used is defined hereafter: With reference to the hand, wrist and forearm the following anatomical terms of location are used:

Anterior—front (palm side)

Posterior—back (knuckle/fingernail side)

Medial—when palm is facing forward, the side of the arm closest to the body

Lateral—when palm is facing forward, the side of the arm/wrist that is further from the body.

SUMMARY OF THE INVENTION

According to the present invention there is provided a wrist device for unlocking a safety holster for use with a weapon, the holster includes an electronically actuated locking mechanism configured to admit the weapon into the safety holster, and to lock the holster, thereby preventing the withdrawal of the weapon prior to release of the electronically actuated locking mechanism upon receipt of an unlock signal, the wrist device including: a wearable band, adapted to be worn on a forearm; a sensing mechanism operationally coupled to the wearable band and adapted to be actuated as a result of a predefined actuation movement of a hand or forearm wearing the wrist device; a wireless communications component configured to send the unlock signal when the sensing mechanism is actuated; and a processing unit in electrical communication with the sensing mechanism and the wireless communications component.

According to further features in preferred embodiments of the invention the sensing mechanism is located on the wearable band in a location which, when the wrist device is worn on the forearm, abuts an anterior side of the forearm.

According to still further features in the described preferred embodiments the sensing mechanism is adapted to sense proximity or contact with another object. According to still further features, the sensing mechanism includes a mechanically actuated sensor. sensing mechanism is an electro-mechanical mechanism including: a spring-loaded button biased to an extended state by a spring, a first contact located on an inner face of the spring-loaded button, and a second contact spaced apart from the first contact by the spring, wherein the electro-mechanical sensing mechanism is actuated when the first contact closes an electrical circuit by coming into contact with the second contact.

According to still further features, the sensing mechanism includes at least one sensor selected from the group including: an optical sensor, an electro-optical sensor, a touch sensor, a proximity sensor, a gyroscope and an accelerometer.

According to still further features, the sensing mechanism includes one of: an NFC tag and a wireless communication component calibrated to sense touch or close proximity to an object or surface.

According to still further features, the sensing mechanism is actuated by a hand gesture of the hand wearing the wrist device. According to still further features, the wrist device further includes a feedback module for providing biofeedback including a means of tactile output. According to still further features, the feedback module further includes at least one of: a visual component and an audio component.

According to another embodiment the wrist device further includes a companion component in electrical communication with the processing unit and is located on the wearable band in a location which, when the wrist device is worn on the forearm, abuts a posterior side of the forearm.

According to still further features, the companion component includes: a light, the light configured to be activated when the unlock signal is sent. According to still further features, the companion component includes a camera, the camera adapted to have a line of sight (LOS) parallel to a LOS of the weapon when held in the hand wearing the wrist device, and wherein the camera configured to be activated when the unlock signal is sent. According to still further features, the companion component includes a microphone, the microphone configured to be activated when the unlock signal is sent. According to still further features, the companion component includes a laser sight, the laser sight configured to be activated when the unlock signal is sent.

According to still further features, the companion component includes one or more accessories, the one or more accessories being activated in a manner selected from the group including: actuation of the sensing mechanism, actuation of the sensing mechanism more than once within a predefined time, actuation of the sensing mechanism by a predefined actuation movement or gesture, and upon receipt of a feedback signal indicating that the weapon has been unholstered. The one or more accessories are selected from the group including: a light, a camera, a microphone, a laser sight.

According to another embodiment the wrist device further includes a reflectance photoplethysmographic (PPG) sensor including a light source and a photodetector located on the wearable band such that when worn the light source and photodetector abut an anterior side of the forearm.

BRIEF DESCRIPTION OF THE DRAWINGS

Various embodiments are herein described, by way of example only, with reference to the accompanying drawings, wherein:

FIG. 11A-11H are various views of a prior art safety holster;

DESCRIPTION OF THE PREFERRED EMBODIMENTS

The principles and operation of a wearable device for unlocking a safety holster according to the present invention may be better understood with reference to the drawings and the accompanying description.

Figure 1:
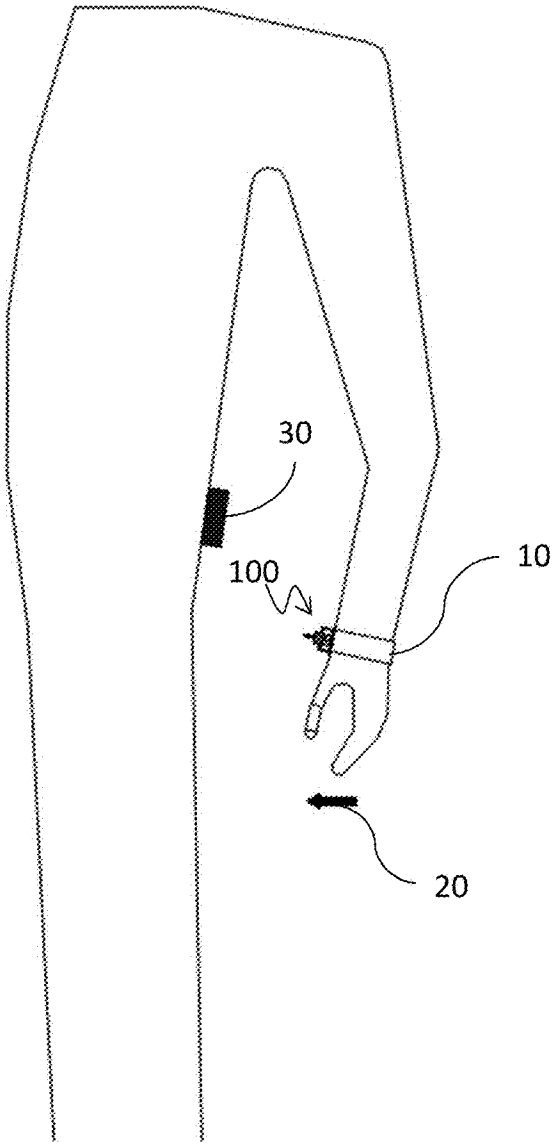
FIG. 1 is a partial view of the wrist or arm-worn device indicating a manner of actuation of the sensing mechanism.

Referring now to the drawings, FIG. 1 illustrates a partial view of the wrist or arm-worn device indicating a manner of actuation of the sensing mechanism. The instant device is a wearable technology preferably placed on a wrist or forearm of a person. The wearable technology is an electrical or electromechanical device that is, attached to, fixed on, integrated with, or otherwise coupled to a band, cuff, strap, bracelet, armband or the like.

For simplicity sake, the term "band" will be used hereafter, but it is made clear that the term is intended as a general term for all the aforementioned types of articles that affix something to the wrist or forearm of a person, as well as articles not mentioned.

For simplicity sake, the term "wrist" will be used hereafter to indicate the location where the band is worn. The term is intended to include any area of the forearm, located between the palm and the elbow. It is understood that the term wrist usually indicates an area of the forearm proximal to the palm, but it is made clear that the term is used herein to indicate any location on the forearm, not just the area proximal the palm.

FIG. 1 depicts a partial view of a body with an arm wearing a wrist band device of the instant innovation. The wrist band apparatus 100 includes a device 100 coupled to a band 10. The device may be integrated with the band or removable from the band.

Figure 2:
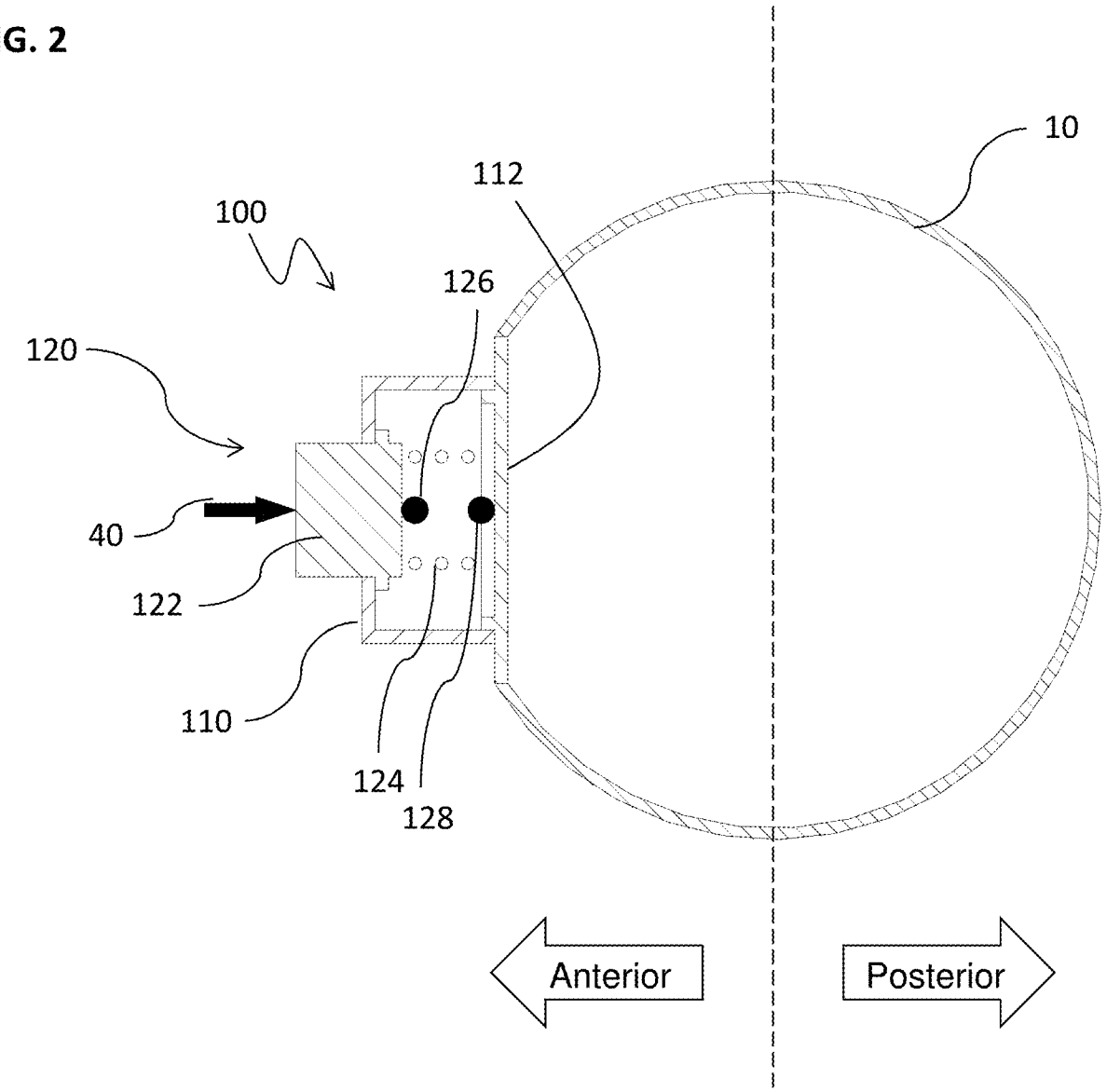
FIG. 2 is a cross-sectional view of an exemplary embodiment of the instant wrist worn technology.

Device 100 includes a central unit 110 and a sensing mechanism 120 (See e.g., FIG. 2). The sensing mechanism is located on an area of the band that touches or is proximal to the anterior side of the wrist. The sensing mechanism is intended to come into contact with user's body, as indicated by arrow 20. The device is actuated when the sensing mechanism senses that the device has come into contact with the body of the user[, or another surface]. Preferably, the sensing mechanism or device is capable of differentiating between intentional contact and unintentional contact.

In some embodiments, a receiving part 30 is worn on the body of the user and the device [i.e., the sensing mechanism] needs to come into contact with the receiving part in order for the device to be actuated.

The innovative device is intended for use with a safety holster (not shown in the Figure but see e.g., FIG. 11A-11H). A safety holster, as used herein, refers to a holster for a weapon (e.g., a gun, taser, baton etc.) that locks the weapon inside the holster until the locking mechanism is released. The innovative device 100 is capable of sending an unlock signal to the safety holster. As described herein, the user wears the device on a band 10 and actuates the unlocking signal by pressing the sensing mechanism against his/her body (or against the receiving part) before retrieving the weapon from the holster.

Mechanical Description of Device

FIG. 2 is a cross-sectional view of an exemplary embodiment of the instant wrist worn technology. All of the cross-sectional views (FIGS. 2, 6-8 and 10) include a midline as well as anterior and posterior indicators for increased clarity. These indicators indicate how the device is intended to be worn on a forearm of a user.

As mentioned, the basic device 100 is comprised of central unit 110 and a sensing mechanism 120. The device is affixed to a wrist band 10. The sensing mechanism may be mechanical, electro-mechanical, electro-optical or any other sensing mechanism. The sensing mechanism is adapted to sense proximity or contact with another object such as, but not limited to, the user's body, the receiving part, a surface or any other part. The sensing mechanism is adapted to be actuated as a result of a predefined actuation movement of a hand or forearm wearing the wrist device. The actuation movement may be pressing the inner wrist to the body or some predefine hand gesture.

In the instant embodiment illustrated in FIG. 2, the sensing mechanism is an electro-mechanical mechanism. The mechanical part of the sensing mechanism is a spring-loaded button 122, which is biased to an extended state by a spring 124. The normal state of the mechanism is an open, extended state. This is a stable state.

The electrical part of the sensing mechanism comprises two electrical contacts. A first contact 126 is located on the inner face of the button 122. A second contact 128 spaced apart from the first contact by the spring. Exemplarily, the second contact may be located on the inner face (device side) of the base surface 112 of the central unit 110. The base surface 112 is the surface that is intended to come into contact with the skin of the wearer or, in some instances (e.g., when a portion of the band runs under the central unit 110), the band 10.

The instant embodiment has a transitional state whereby the button is pushed (in the direction of arrow 40), compressing the spring and bringing the first contact into electric contact with the second contact. Touching the electrical contacts 126, 128 together closes and electrical circuit. Accordingly, the transitional state is characterized by a compressed spring and a closed electrical circuit. Conversely, the stable state is characterized by an extended spring and an open circuit.

When the electrical circuit is closed, the sensing mechanism is actuated, and a wireless communications signal is sent to the safety holster. The wireless signal causes a locking mechanism in the safety holster to unlock. The holster transforms from a locked state to an unlocked state. Once unlocked, the weapon can be withdrawn from the holster.

In summary, the instant, exemplary embodiment, the device has a single stable state (open circuit, extended spring) and a single transitory or transitional state (closed circuit, depressed spring).

Figure 3:
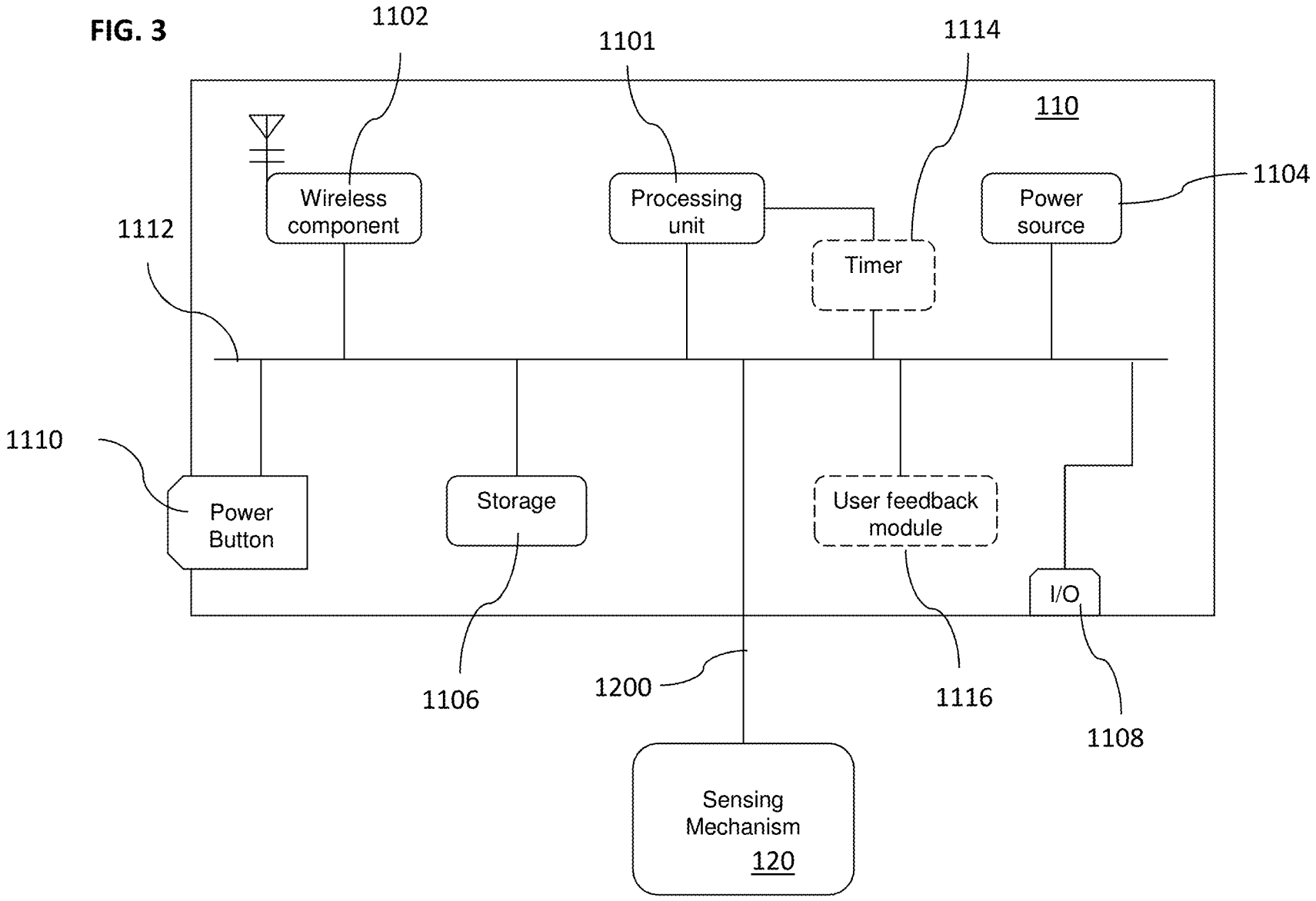
FIG. 3 is a high-level block diagram of the device 100.

FIG. 3 illustrates a high-level block diagram of the device 100. Central unit 110 includes a processing unit (e.g., as part of a microcontroller) 1101, a wireless component 1102, a power source 1104, a storage device (such as a solid-state storage device, flash memory) 1106 and an input/output port 1108 and a power button 1110. All of the components are in communication with each other via connecting lines (power and signal) coupled to a central bus 1112. A sensing mechanism 120 is (exemplarily) disposed outside the central unit but (in all embodiments) in electrical communication with the central unit via a connection line 1200. It is made clear that the sensing mechanism may be disposed within the central unit and/or integrated with the central unit.

The microcontroller is an exemplary component that includes at least a processing unit 1101 which controls the other components of the device. The I/O port 1108 can be a power port and/or a data port. Power source 1104 is preferably a chargeable battery. Storage/memory 1106 holds a holster specific passcode or key that is assigned during calibration for increased security, so that the pairing between the device is a one-to-one pairing and no other device can unlock the holster. The storage is non-transitory memory that also includes the software and/or firmware that is loaded into the RAM and includes computer-readable instructions for the processor of the microcontroller.

Figure 4:
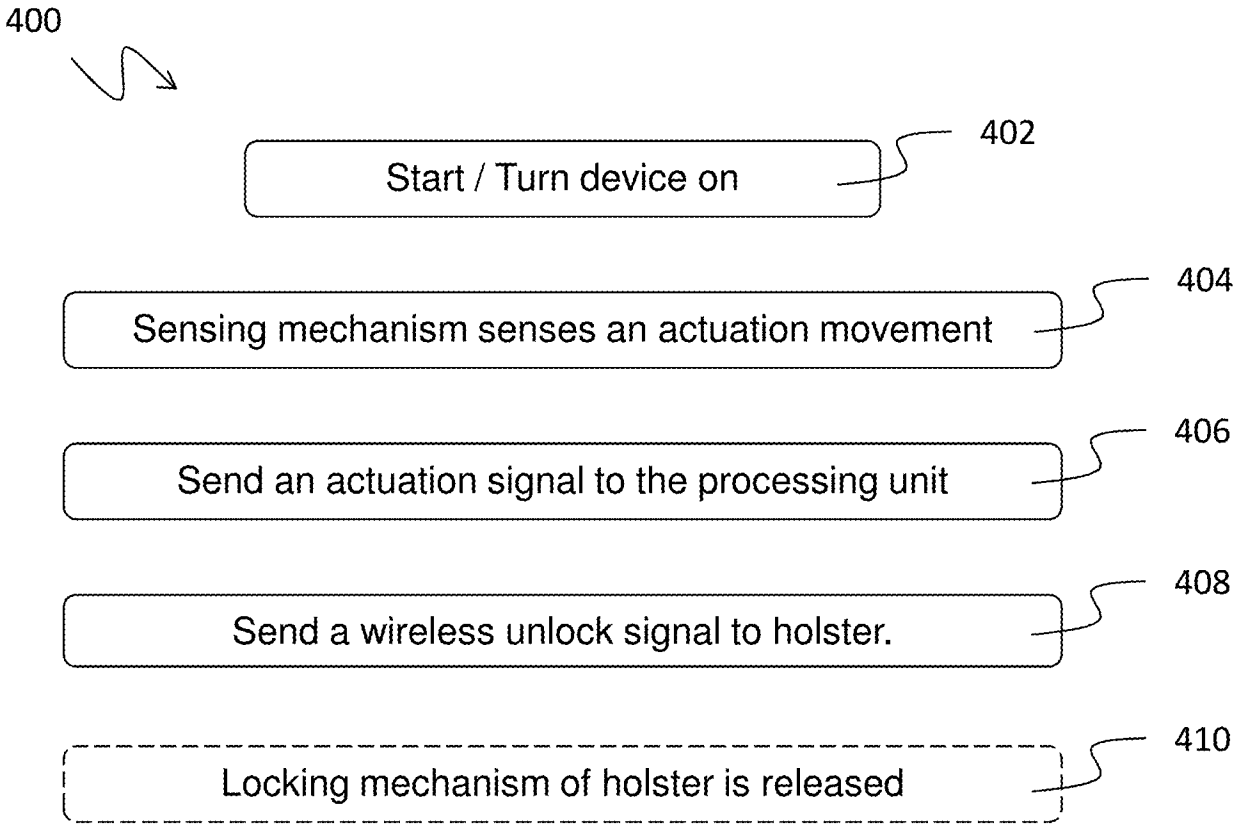
FIG. 4 is a flow chart 400 of the process steps for the invention.

FIG. 4 is a flow chart 400 of the process steps for the invention. At step 402 the process starts by turning the device on (e.g., actuating power button 1110). The device 100 is worn on strap 10 with the sensing mechanism disposed on the anterior side of the forearm (inner wrist).

At step 404 the sensing mechanism senses an actuation movement. An actuation movement is any predefined movement that the sensing mechanism is predisposed to perceive as actuating the sensing mechanism, or simply a movement that results in the actuation of the sensing mechanism. For example, according to the embodiment of FIG. 2, the sensing mechanism is actuated when the electro-mechanical circuit of the sensing mechanism is closed, by depressing the button 122.

Exemplarily (using the example of FIG. 2), a user may actuate the device by pressing the wrist-worn device against his/her body as their hand travels to the holster. This quick, distinct and intentional movement presses the extended button into the closed, depressed state, where the circuit is momentarily closed before the spring biases the button back to the open, extended state. The user's hand continues to travel to the holster which is now unlocked.

In step 406, after the sensing mechanism is actuated in step 404, a signal (e.g., an electrical pulse) is sent to the central unit 110 (e.g., to the microcontroller/processing unit) indicating that the device has been actuated.

In response to the actuation signal from the sensing mechanism, in step 408, the central unit sends an unlock signal to the proximally located safety holster. A prior art, non-limiting, exemplary gun holster with a remotely actuated locking mechanism is shown in FIGS. 11A-11H.

In some cases, there is no separate signal from the sensing mechanism to the central unit and a subsequent wireless signal from the central unit to the holster, rather, actuation of the sensing mechanism results in sending the unlock signal such that step 406 is obviated and the process goes from step 404 to step 408.

In step 410, the locking mechanism of the holster is released/unlocked and the firearm/weapon can be withdrawn from the holster. Step 410 is a step which can be viewed as being outside the scope of the present innovation, which is directed to the wrist-worn device. Accordingly, this step is shown in a broken line, on the flow diagram 400.

In FIG. 3, Sensing mechanism 120 is depicted outside of, or separate from, central unit 110, however, this configuration is merely one optional configuration. In other configurations, the sensing mechanism may be an integral part of the central unit. For example, device 100 may be a System on Chip (SoC) with all the component integrated onto a single integrated chip (IC). In other configurations, the central unit and sensing mechanism may be separate components assembled together and in electrical communication with each other.

The sensing mechanism may be a component of the central unit, may be housed in a common housing as the central unit, may be a separate unit in electrical communication with the central unit, or any other configuration whereby the sensing mechanism is collocated with the central unit and in electrical communication with the sensing unit.

In all embodiments of the innovative device, the central unit 110 includes a processing unit/microcontroller (or similar component capable of performing the functions discussed herein), a power source, a wireless communications component, a power button as well as the necessary circuitry and computing components. According to the configuration of a separate sensing mechanism and control unit, the central unit has two basic functions: (1) receive a signal from the sensing mechanism, indicating that the device has been actuated; and (2) sending an unlock signal to the holster. The sensing mechanism may be integrated with the central unit in such a way that sensing the actuation movement causes the wireless signal to be sent (without there necessarily being a separate signal from the sensing mechanism to the central unit). To clarify, the 'signal' that is 'sent' between the sensing mechanism and the central unit may be an actual electric pulse passing between two components or may just be the central unit registering ('receiving a signal') that the sensing mechanism has sensed the actuation movement.

In another embodiment, the sensing mechanism may be an electro-optical mechanism. The electro-optical mechanism is actuated in a similar fashion to the electro-mechanical mechanism described with reference to FIGS. 1 and 2. The optical sensor senses that the sensor has been brought into contact with (or very close to) an object or surface such as the user's body (e.g., a momentary touch of the sensor to the side of the torso below the ribcage, or to the thigh or belt, etc. using a deliberate movement which only slightly deviates from the path of the hand to the holster) and sends the signal to the central unit (e.g., to a processor in the central unit) which in turn sends a wireless signal to nearby holster. As mentioned, sensing/registering of the actuation movement by the sensing mechanism causes the unlock signal to be sent (may be direct causality or may be the result of sending an electronic signal).

In another embodiment, the sensing mechanism may be an NFC tag with companion receiver worn on the body part that is closest to the path of the hand to the holster. The user momentarily brings the sensing mechanism into proximity or contact with the receiver effecting an inductive coupling between the loop antenna of the tag and the loop antenna of the receiver, as is well known in the art.

Many other similar short-range wireless technologies can be used in place of the NFC tag. Most wireless communication technologies use radio waves to effect communication. It may be that other wireless communication technologies would need to be calibrated for touch or activation only when in very close proximity, so as not to actuate the mechanism inadvertently.

Another sensor that can be used in the sensing mechanism is a proximity sensor. With the appropriate calibration, and in some cases a companion receiving patch on the user's clothing, a proximity sensor can be used to sense or register the predefined actuation movement and cause the unlock signal to be sent. Another type of sensor is a touch sensor, such as a capacitive sensor. Many other sensors that are capable of sensing proximity, touch, pressure, etc. are known in the art and considered to be within the scope of the instant innovation.

In yet another embodiment, the sensing mechanism may include a gyroscope and/or accelerometer which can register a specific, predefined hand gesture that indicates the user's intention to access the weapon in the holster. Such an embodiment does not necessitate the user bringing the device into contact, or even proximity, to the body but rather any hand gesture that is defined as the unlocking movement of the device can be employed to convey the intent. The actuation movement, whatever the hand gesture may be, is sensed or registered by the sensing mechanism causes the wireless unlocking signal to be sent to the holster.

In all of the above embodiments, it is most preferred that the specific holster is encoded to the specific device for added security. The instant innovation can be implemented in many ways. The first, most simple configuration has been described above. The device 100 is attached to a band 10 and worn on a wrist. The device is actuated by a user making an actuation movement that is sensed by the sensing mechanism of the device which then transmits a wireless signal to the safety holster to unlock the holster. The necessary components are illustrated (in solid boxes) in FIGS. 2 and 3 and the process defined in FIG. 4.

In the simple configuration described above, the device sends signals but is not interested in knowing what the result of the signals is (a variation of the concept of Fire-and-Forget used in missiles). Therefore, the wireless component may even only be a transmitter and not a receiver. On the other hand, there may be versions or embodiments of the simple configuration where the wireless component is a transceiver, that can also receive wireless signals. For example, the device may receive software or firmware updates wirelessly. In another example, the device may be calibrated (including a step of pairing the device with a specific holster) and/or programmed via the transceiver of the wireless component.

The above notwithstanding, some configurations may have additional features. For most of the additional features described hereafter, as well as the more complex configurations described below, it is preferred, and in most cases necessary, that there be feedback from the safety holster. The feedback is received by the wireless component which must include a transceiver (as opposed to having just a transmitter).

An example of feedback is an indication (e.g., a wireless signal), from the holster (which has its own communications component) that the weapon was indeed drawn from the holster. In such a case, the holster may remain unlocked until the weapon is reinserted into the holster. In some embodiments, this type of feedback is used for other purposes as will be discussed below.

In another example, the feedback may be that the weapon was not withdrawn from the holster and consequently, after a predetermined time lapse (registered by a timer module 1114 in the central unit), the holster was relocked. A timer 1114 is an optional feature of the central unit and as such, indicated by a broken line. Of course, the depicted configuration of the timer module 1114 outside the processing unit 1101 is merely exemplary but not limiting in any way. Alternatively, the mere lack of an 'unholstered' feedback signal coupled with the timer counter lapsing indicates to the device 100 that the holster has relocked itself.

Means for communicating the status of the holster to the user is an additional, optional feature. Preferably, the status of the holster (i.e., that the holster has been relocked) is conveyed to the user via feedback means perceivable by one or more of the senses touch, sight and hearing. The feedback is preferably tactile (a user may not see or hear other types of feedback). For example, if the holster relocks, the wrist worn device 100 may vibrate to inform the wearer that the weapon can no longer be withdrawn without performing another actuation movement. In some embodiments, a visual and/or audible indication additionally conveys this information to the user.

The tactile and/or visual and/or audible feedback is provided to the user via a feedback module 1116 that is an optional feature of the central unit 110 (and therefore indicated by a broken line). The feedback module includes at least a means of tactile output such as vibrator. The feedback module may further include a visual component (e.g., an LED or control over an existing LED such as a power button LED that may blink when the holster is unlocked and be steady when the holster is locked). Additionally, or alternatively to the visual component, the feedback module may have an audio component such as a speaker for issuing an audible signal.

The forthcoming features and configurations described hereafter include all of the components described previously. The components that have been described as necessary are also necessary going forward. The components that have been described as optional may either be optional or necessary, based on the context and new features. As such, each new feature or configuration is built on the previous configuration and must be seen as if all the components previously described are fully described for each configuration. Likewise, same or similar components have similar reference numbers in all the Figures. As mentioned elsewhere, later configurations and embodiments inherit the 'rules', options of variations, and/or optional features of earlier configurations and embodiments Likewise, features described for later configurations and embodiments that can be applied to earlier configurations and embodiments are to be seen as if fully set forth for each of the earlier embodiments.

Figure 5:
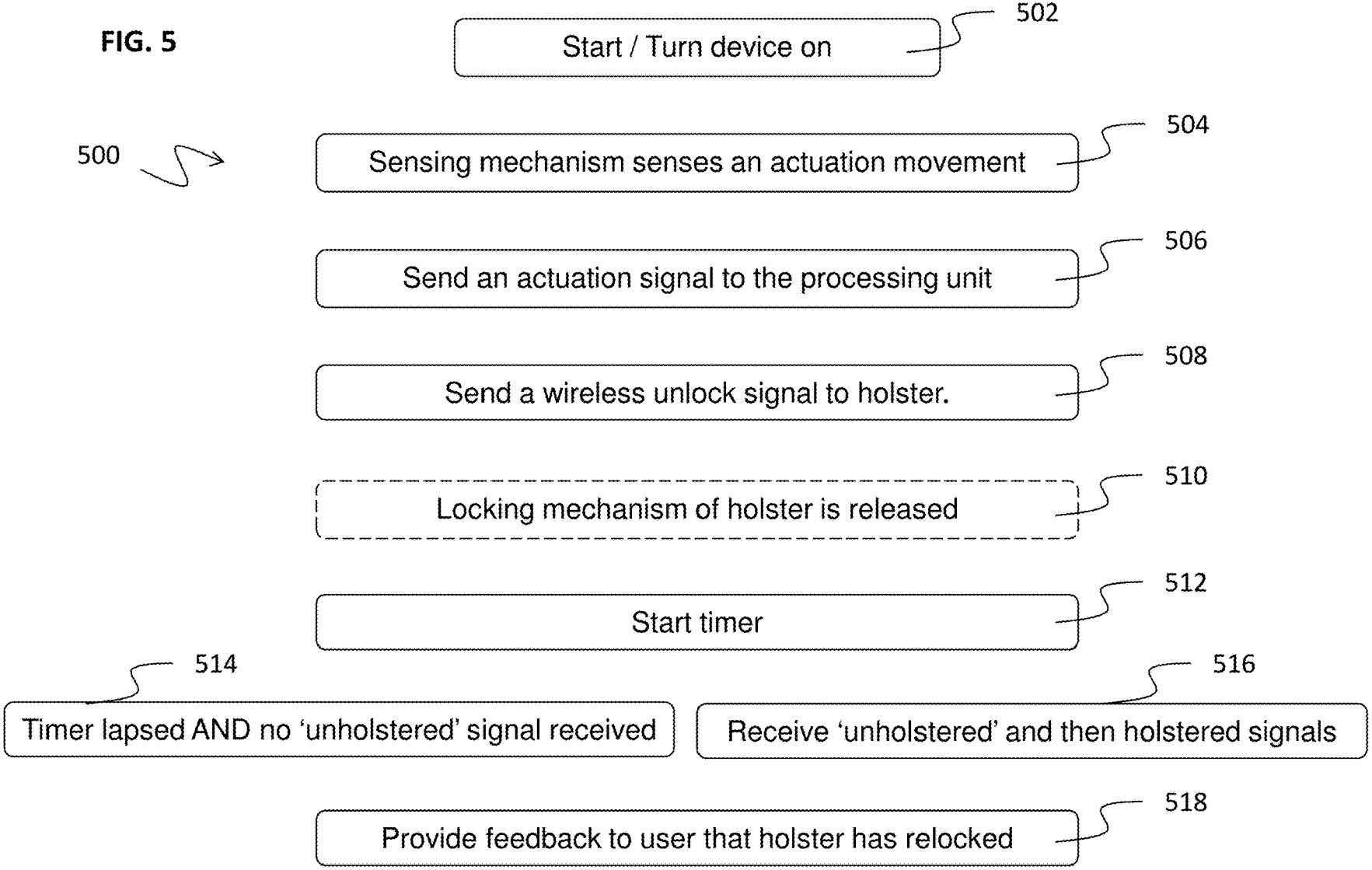
FIG. 5 is a flow diagram 500 of a process including feedback from the holster and feedback to the user.

FIG. 5 is a flow diagram 500 of a process including feedback from the holster and feedback to the user. Steps 502 to 510 mirror steps 402 to 410 and may likewise not include step 506. Step 502, process starts when device is switched on. Prior to the first use, the device is calibrated (in cases where calibration of the sensor is needed) and paired with the specific holster. In step 504 the sensing mechanism senses an actuation movement (physical manipulation of the sensing mechanism, movement of the device and/or a hand gesture, all as described above). In step 506 the sensing mechanism sends an actuation signal to the central unit (e.g., to the microcontroller). As described above, this step may be integrated into the previous step such that central unit registers the actuation movement when sensed by the sensing mechanism. In step 508, the device sends a wireless unlock signal to the holster. In step 510, the holster locking mechanism unlocks. This step is not, per se, a process step that pertains to the working of the device but is nonetheless relevant.

In step 512, a countdown timer is started. If an 'unholstered' signal is received, the timer is stopped. In step 514 the unholstered signal is not received by the timer the countdown timer has expired. When the timer ends without an unholstered signal, the process continues at step 518 where the device registers that the holster has relocked and provides biofeedback (tactile, audible and/or visible feedback) to the user via the feedback module.

In step 516 an unholstered signal is received. The timer is stopped. Only when a new 'holstered' signal is received from holster, indicating that the weapon was returned to the holster, does the process continue to Step 518 as described heretofore.

After discussing a specific configuration and then generalizing to all embodiments, the following discussion returns to another specific configuration. It is again made clear that the more complex configurations build on the simpler configurations and therefore the added physical components and accompanying features are to be viewed as including all of the detailed description discussed heretofore. The more complex configurations and embodiments build on the simpler embodiments but also inherit the alternatives, variations and optional characteristic of the simpler configurations. For example, the timer is an optional feature of one configuration described above. All of the future configurations inherit the option of the timer. This rule applies to all the components and features.

Figure 6:
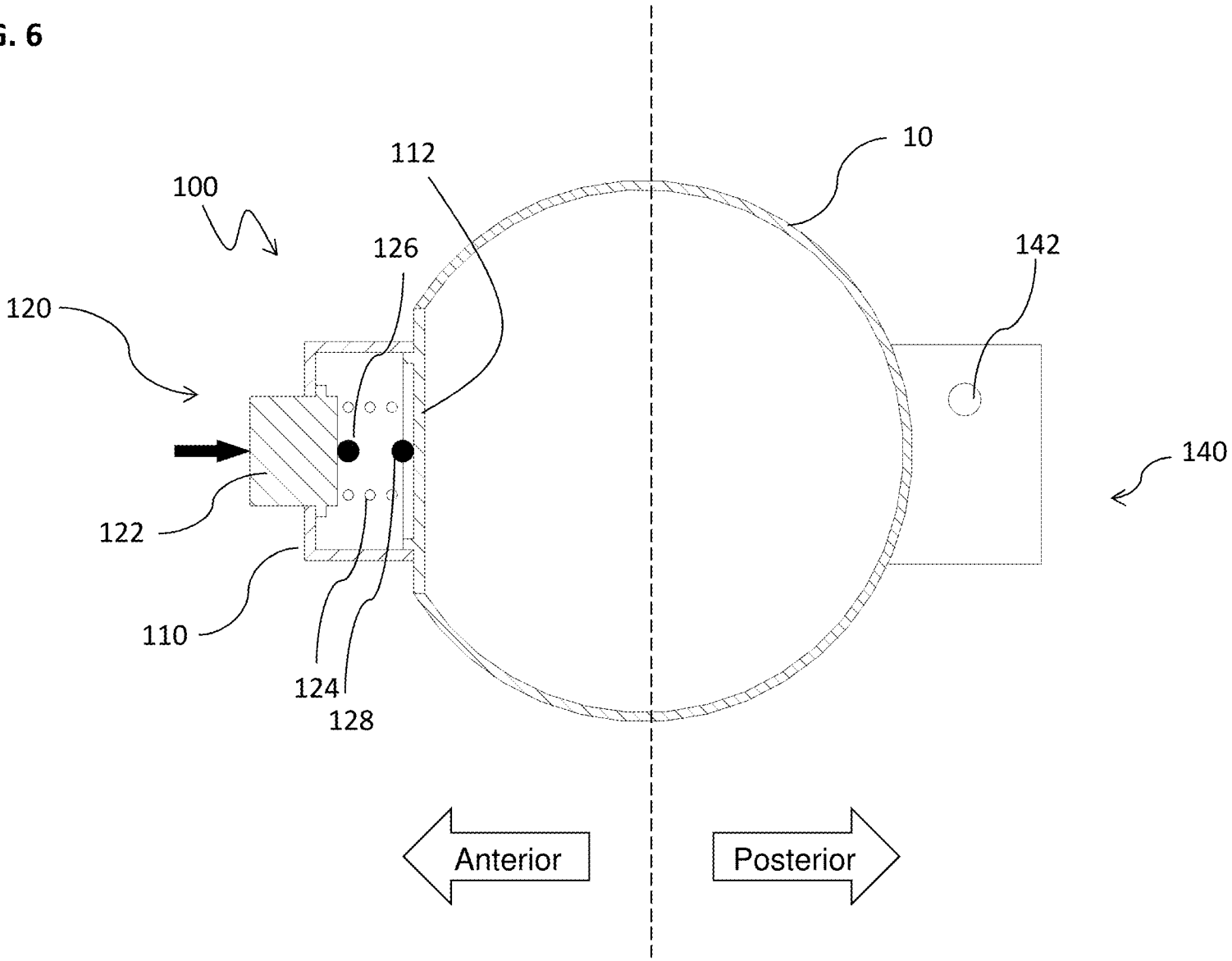
FIG. 6 is a cross-sectional view of an embodiment of the innovative device including a companion unit 140.

Another possible configuration is shown in FIG. 6, which illustrates a cross-sectional view of an embodiment of the innovative device including a companion unit 140. The companion unit 140 is disposed on the side of the band opposite to the side upon which the central unit 110 and sensing mechanism 120 are disposed. The companion component abuts the posterior side of the forearm of the user when the device is worn on the wrist/forearm. The companion component is coupled to band 10. The companion component is in electrical communication with the central unit 110. The companion component may be in wired or wireless communication with the central unit. Additionally, or alternatively, the companion component may be in communication with the safety holster.

Companion component 140 is adapted to house one or more accessories. In one embodiment, the accessories (optional accessories detailed hereafter) can be activated when the sensing mechanism is actuated by the actuation movement. According to embodiments, when the sensing mechanism is actuated, the central unit sends a signal (wired or wireless) to the companion component to activate one or more of the accessories. According to other embodiments, the accessories of the companion component are activated based on the feedback signal from the holster indicating that the weapon was withdrawn from the holster. For example, when the central unit receives the feedback 'unholstered' signal, it sends an activation signal to the companion component to activate one or more accessories.

One exemplary accessory is a light 142 such as a light emitting diode (LED) or some other type of illuminator. When activated, the light shines in front of the firing hand that presumably is holding the weapon. Preferably, the light beam is sufficiently tight and distanced from the hand so that the hand holding the weapon does not obstruct the beam and cast a shadow. The light may be angled or adjustable to correctly calibrate the beam prior to usage. The accessory light obviates the need for either a mounted light or a handheld flashlight. According to the aforementioned embodiments, the light is activated either when the sensing mechanism is actuated or when the weapon is withdrawn from the holster and an unholstered signal is received at the device.

In preferred embodiments, the light 142 or companion component 140 has a light sensor which provides input to the device to know whether to allow the light to be automatically activated (e.g., in a dark place or at night) or not (e.g., in a well-lit area or during the day). The light sensor (or any other functionally equivalent component) helps conserve battery power by not activating the light in unnecessary situations.

Alternatively, or additionally, the light can be switched on when the sensing mechanism is actuated a second time. That is to say that the before the user unholsters the weapon, the sensing mechanism is actuated a first time to unlock the holster, and then it can be actuated a second time (either before or after unholstering the weapon) to activate the light. So, for example, the user may double tap the device against their body to unlock the holster and switch on the wrist light 142 as they move to unholster their weapon.

Alternatively, or additionally, the light can be activated with a completely different movement. For example, a hand gesture (that is sensed by the sensing mechanism) or other movement of the hand/arm can activate the light 142. In such a case, activation of the light is not dependent on unlocking the holster. The user can activate the wrist light with a hand gesture (e.g., flicking the wrist, or any other non-typical movement) even in a situation that does not require the use of a weapon.

To summarize, there are three options for activation of the light 142: (1) automatic activation when the safety holster is unlocked; (2) activation by repeating the same actuation movement that unlocks the holster; and (3) actuation by a distinct, independent movement, unrelated to unlocking the holster.

Figure 7:
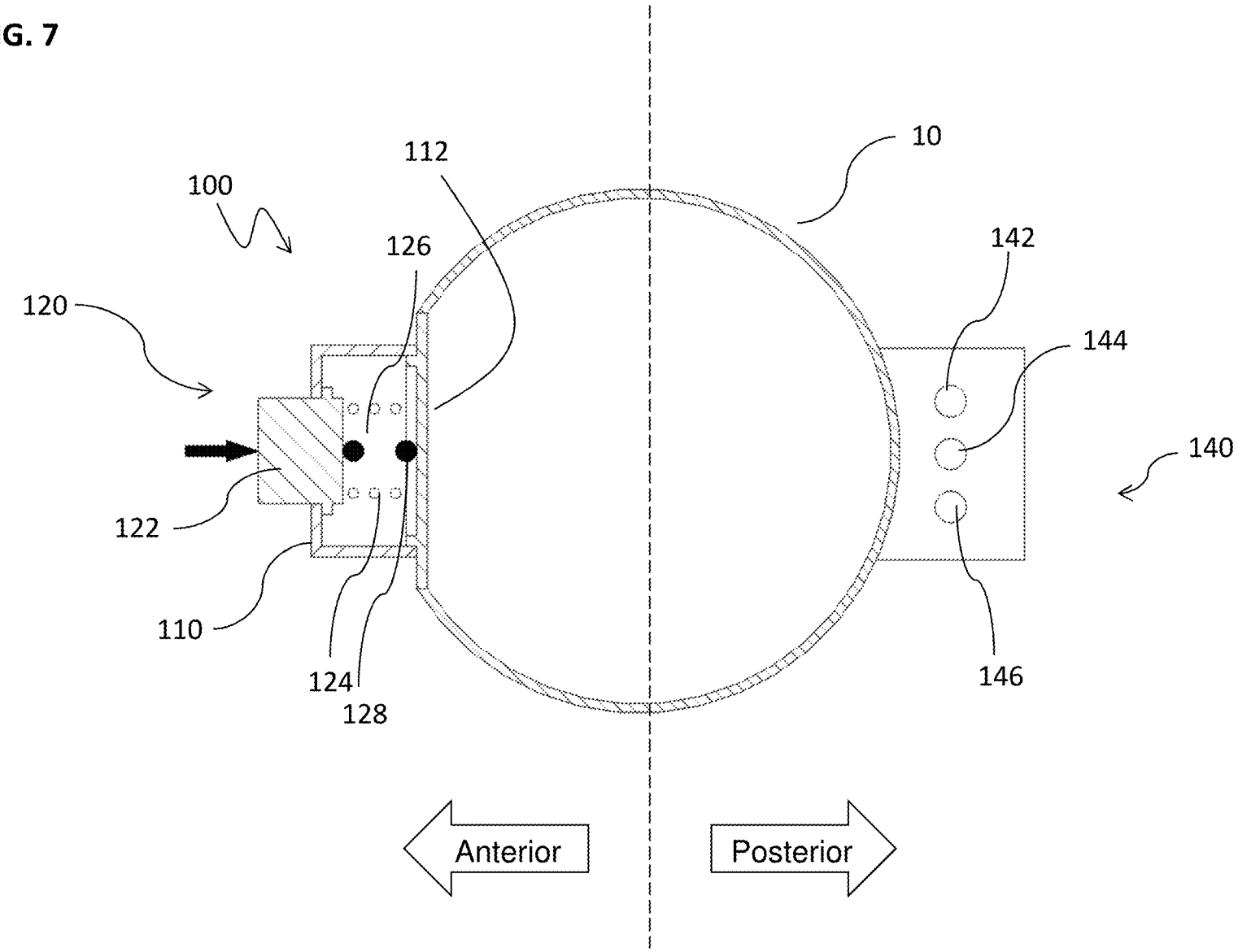
FIG. 7 is a cross-sectional view of another embodiment of the innovation.

FIG. 7 illustrates a cross-section of another embodiment of the innovation. The additional accessories depicted in FIG. 7 can provide audio and/or visual documentation of an unholstering event. The audio and/visual data may be locally stored, remotely stored (e.g., when uploaded to the cloud), transmitted to a remote location or some combination of thereof.

One additional, optional accessory of the companion component 140 is a camera 144. For many reasons it is preferable to have both a camera 144 and a light 142. However, it is to be understood, that one embodiment of the device includes only a camera without the light while another embodiment includes both the camera and the light. Camera 144 camera has a line of sight (LOS) that is parallel to a LOS of the weapon when held in the hand wearing the wrist device. The camera is therefore able to capture imagery (stills or, preferably, video) from the perspective of the weapon.

FIG. 7 actually depicts three accessories, light 142, camera 144 and a microphone 146. However, this configuration is merely exemplary, and it is made clear that any of the three components may be present by themselves or in addition to only one of the other accessories. As such, in embodiments, the camera may be the only accessory present on the companion component 140 without the light or microphone. Alternatively, microphone 146 may be the only accessory without the camera or light. Further alternatively, the camera and microphone may both be present without the light.

The term 'camera' as used herein is intended to cover any and all options of imaging sensors that can be integrated into a wearable device. The various options are too numerous to enumerate within the instant document, but it is understood that cameras known in the art are considered to be included in the scope of the innovation.

Additionally, the term camera is not intended to be limiting to a single sensor or lens but rather to refer to one or more imaging sensors. For example, the companion component may include a combination of sensors such as: one sensor for close range, one for distance, one for lowlight and one fish-eye lens with a wider-than-typical field of view. Other types of image sensors known in the art may alternatively or additionally be included. The imagery captured may be still images, video, low-resolution video, high-resolution video, grayscale, full color etc. The options are virtually endless while the practical considerations take into account, cost, size, physical space, power consumption, memory and the like.

In preferred embodiments, the camera automatically activates when the holster is unlocked. One manner of performing this is that the same mechanism that causes the unlock signal to be sent to the holster also causes the camera to be activated. In other embodiments, the camera is only activated when an unholstered signal is received at the device. Additionally, the camera may be activated via other means even when the weapon is not intended to be unholstered. For example, a predefined hand gesture or movement may activate the camera. A user may wish to independently activate the camera in order to capture video and/or still images (for example, as evidentiary matter).

In some embodiments, the microphone is activated together with the camera. In other embodiments, the microphone is activated independently of the camera (e.g., with an additional activation movement or a distinct activation movement). In other embodiments, the microphone is activated when the sensing mechanism is actuated or when the weapon is unholstered (e.g., in embodiments without a camera, or in embodiments where the camera is not automatically activated in the same circumstances). Alternatively, or additionally, the microphone may be activated by a distinct hand movement or gesture, independent of whether the holster has been unlocked or the weapon unholstered. In other embodiments the microphone is activated when the sensing mechanism is actuated a second time, within a predefined time, or while the holster is unlocked.

The light, camera and/or microphone are deactivated either by a deactivation movement registered/sensed by the sensing mechanism or when the holster is relocked (i.e., when the weapon is returned to the holster). The deactivation movement may be the same movement as the activation movement or may be a different, distinct movement.

In all embodiments, the camera and/or the microphone and/or the light is/are activated in a predefined manner or in one of a plurality of predefined manners. Likewise, the camera/light/microphone is/are deactivated in a predefined manner or in one of a plurality of predefined manners (e.g., by a deactivation movement sensed by the sensing mechanism that is the same as, or different from, the activation movement, or when the weapon is re-holstered).

Figure 8:
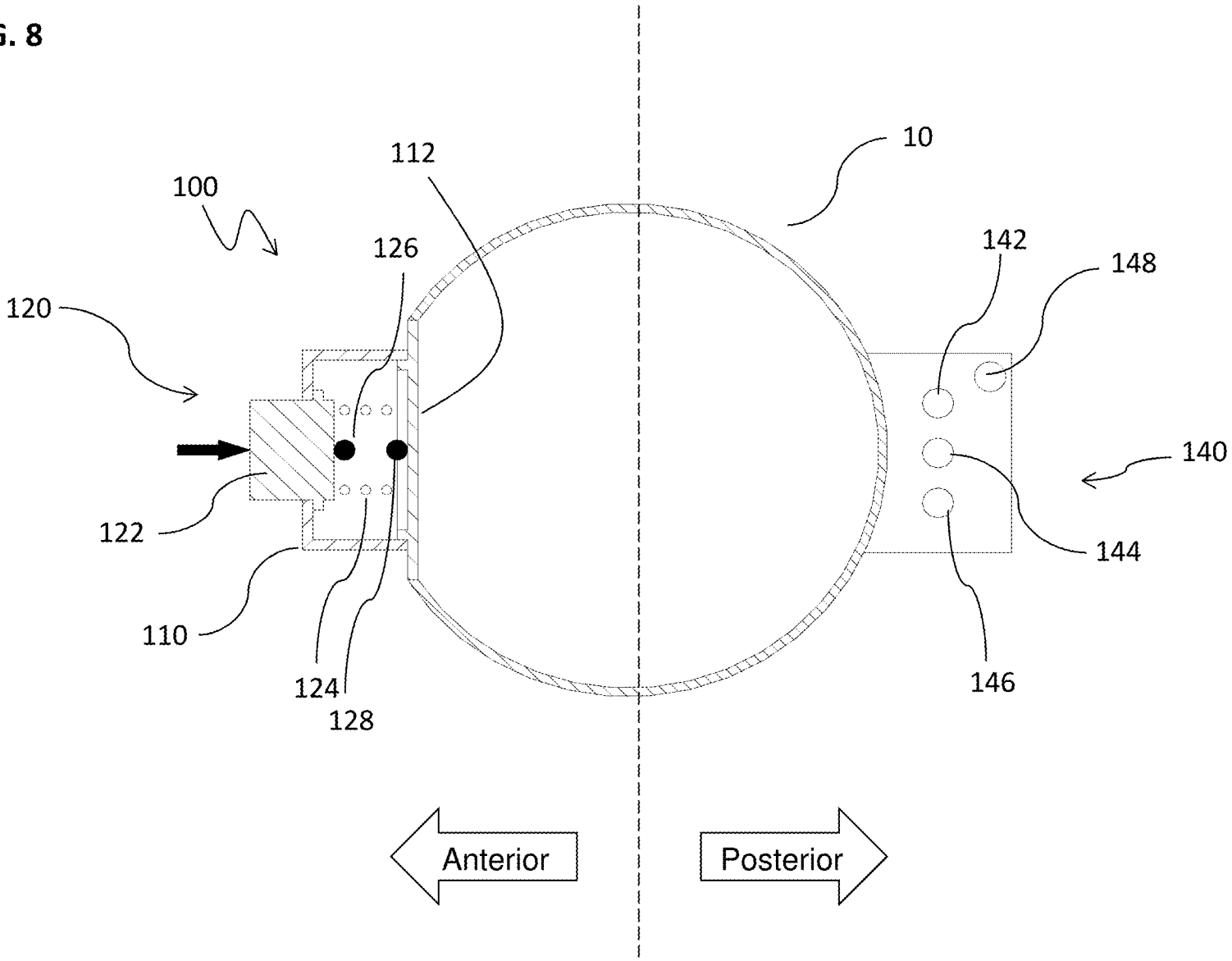
FIG. 8 is a cross-sectional view of yet another exemplary embodiment of the innovative device.

FIG. 8 depicts a cross-sectional view of yet another exemplary embodiment of the innovative device. FIG. 8 depicts all of the components as FIG. 7 with the addition of a laser sight 148. A laser sight is a red-dot sight that 'paints' a red dot on target when the laser hits the target. Preferably, the laser sight is adjustable such that it can be zeroed to the boresight of the weapon when held in the user's hand. The laser sight or laser dot is an aiming aid which improves the firing accuracy of a weapon.

As with FIG. 7 and the corresponding description, the laser sight may be the only accessory on the companion component or one or more of the other accessories may also be included on the companion component. All of the options discussed above apply to the present Figure, mutatis mutandis. As with the other accessories, the laser sight may be activated when the weapon is unholstered (or intended to be unholstered as above) and/or it may be activated independently either with the same activation movement being repeated or with a different activation movement (e.g., hand gesture or arm movement).

In all embodiments, the laser light 148 is activated in a predefined manner or in one of a plurality of predefined manners. Likewise, the laser sight is deactivated in a predefined manner or in one of a plurality of predefined manners (e.g., by a deactivation movement sensed by the sensing mechanism that is the same as, or different from, the activation movement, or when the weapon is re-holstered).

In summary, the companion component includes one or more accessories. Exemplary accessories described above include a light, camera, microphone and laser sight. Other accessories may be added to the companion component. Each of the one or more accessories may be activated in one or more of the following ways: when the unlock signal is sent, when the sensing mechanism is actuated more than once within a predefined time, in response to a predefined movement or gesture sensed by the sensing mechanism (where the movement or gesture is different from the actuation movement that causes the unlock signal to be sent) and/or upon receipt of an unholstered feedback signal from the holster.

Figure 9:
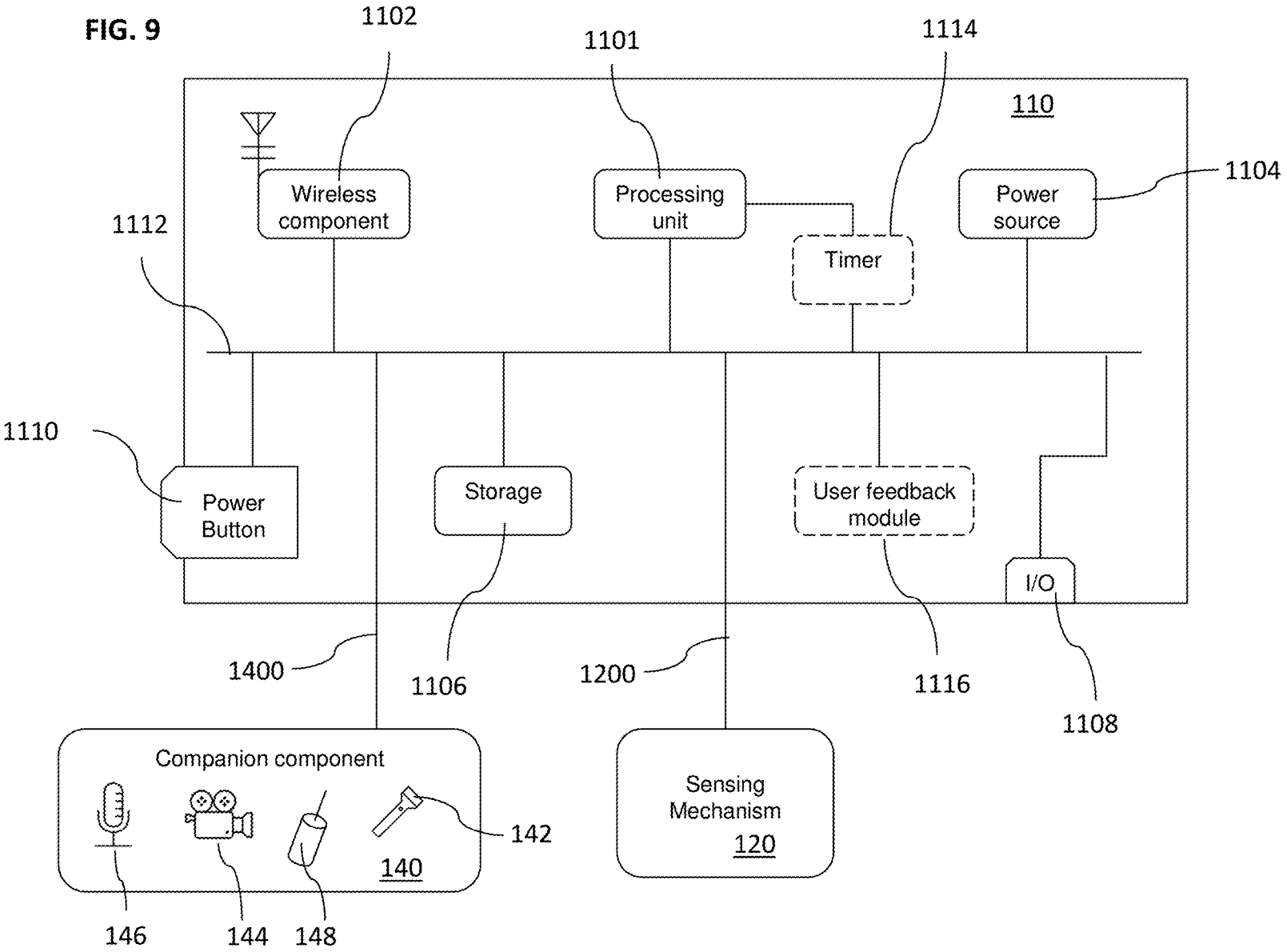
FIG. 9 is a block diagram of the components of an embodiment of the innovation including the companion component 140.

FIG. 9 is a block diagram of the components of an embodiment of the innovation including the companion component 140. The diagram of FIG. 9 is similar to the diagram of Fig. but with the addition of the companion component 140. The companion component includes one or more of the accessories: light 142, camera 144, microphone 146 and laser 148. In the exemplary configuration, the companion component, and the one or more accessories, are in electrical communication with the central unit 110 via line 1400. The companion component may be in wired or wireless communication and accordingly, line 1400 may be a physical power and data cable or merely indicative of a wireless connection.

Preferably, the companion component is in wired communication with the central unit. As such, the various accessories can draw power from the power source 1104. The audio and/or visual data from the camera and/or microphone can be stored on storage 1106. Activation and deactivation of the accessories can be controlled by micro controller 1101. Wireless component 1102 can wirelessly broadcast the audio and/or visual data in real time to a third party or not in real time. The data can be accessed by a third-party device wirelessly (via wireless component 1102) or via a wired connection with a connector inserted into the Input/Output port 1108.

Figure 10:
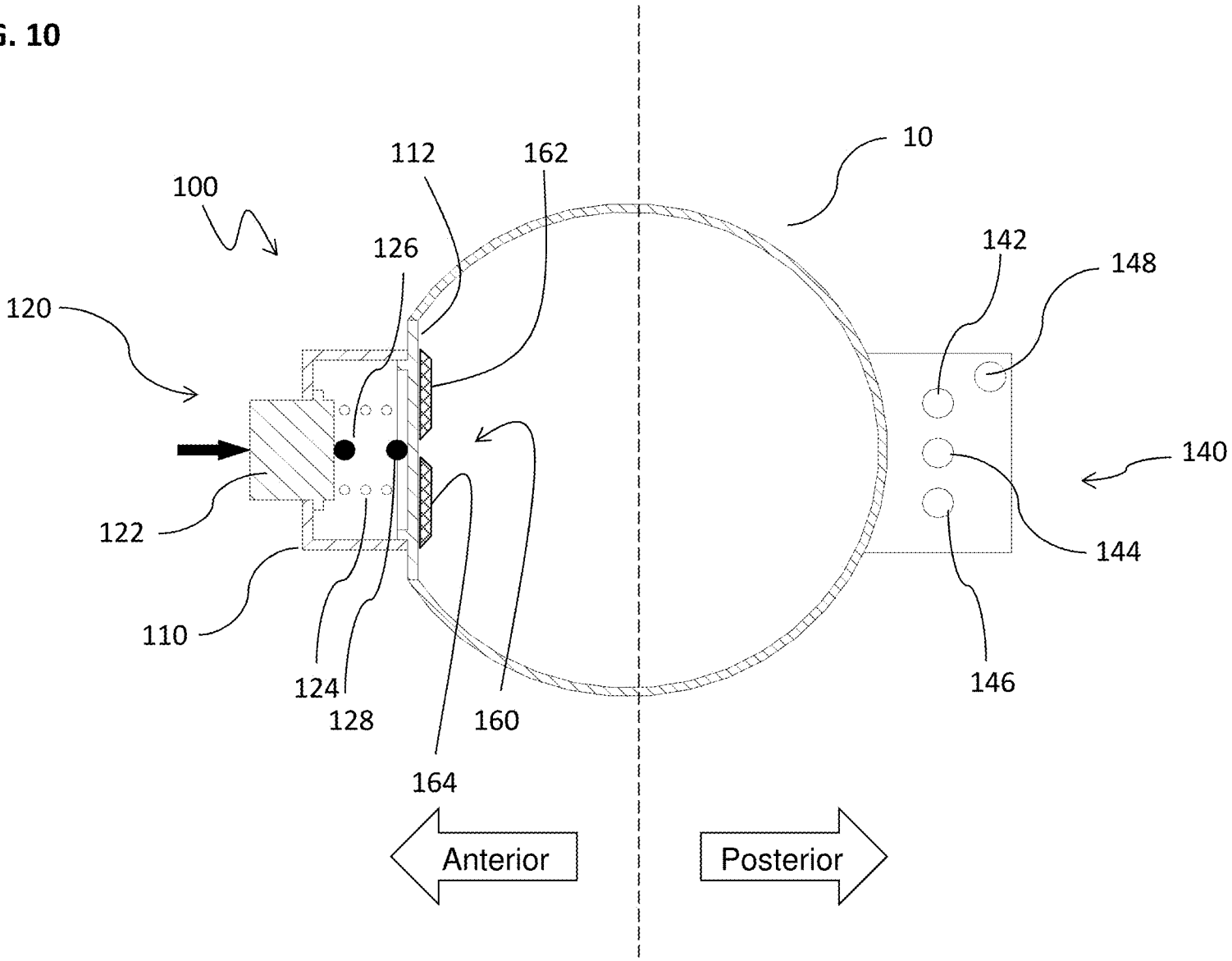
FIG. 10 is a cross-sectional view of an exemplary embodiment including a health sensor 160.
Figure 11A:
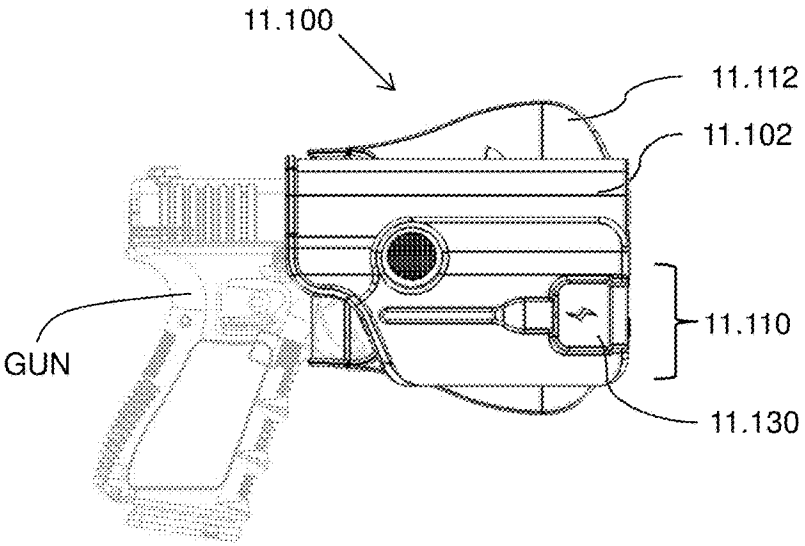
PRIOR ART Fig. 11A
Figure 11B:
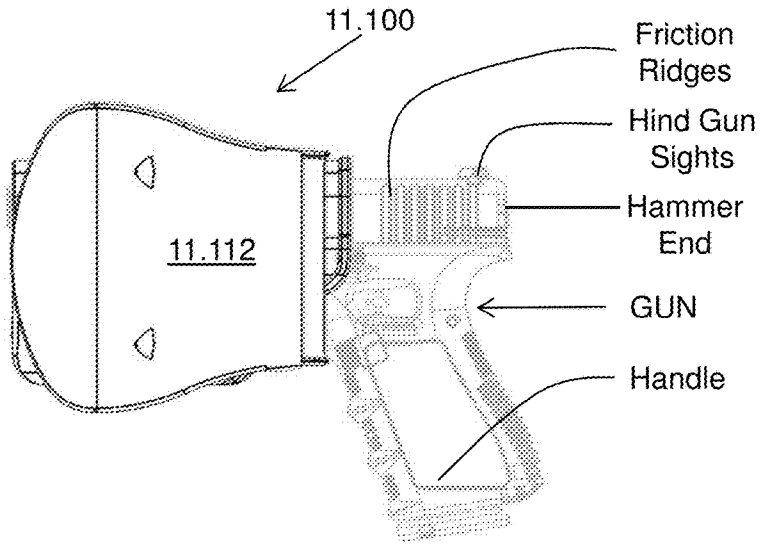
Figure 11C:
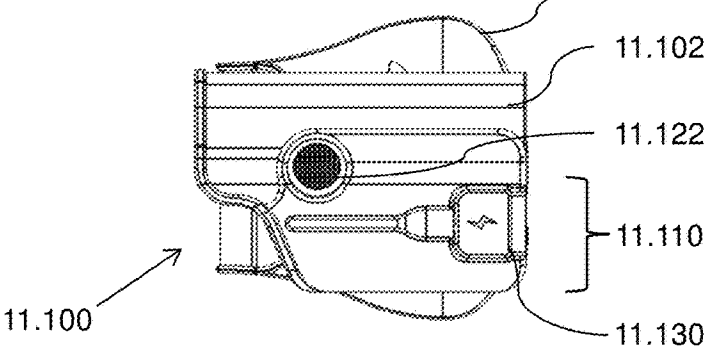
Figure 11D:
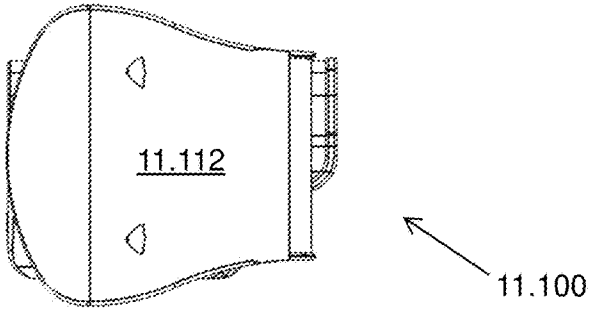

Yet another configuration is shown in FIG. 10 which illustrates a cross-sectional view of an exemplary embodiment including a health sensor 160. In one embodiment, the health sensor 160 is a photoplethysmographic (PPG) sensor. PPG sensors utilize a light-based technology in order to detect the amount of arterial blood volume changes (flow) in a confined area (for example a fingertip) as a consequence of the heart's beating and pumping action. Basically, PPG sensors detect the differences or changes in the light intensity by reflection from or transmission through the tissue. These differences or reflections are highly associated with the variations in the blood perfusion of the tissue and these variations can assist in detecting the heart-related information of the cardiovascular system.

PPG sensors are generally designed to operate in two dissimilar modes, which are called the transmittance mode and reflectance mode. In the reflectance mode, the light source and the photodetector are placed side-by-side on a common axis to be able to detect the reflected signals from the tissue. The benefit of using reflectance mode PPG sensors is that they are not limited to just a few measurement sites; they can be placed on a vast range of measurement locations such as the chest and wrist, which guarantee flexibility of the users specifically during physical activities.

The instant PPG sensor 160 is a reflectance mode PPG sensor which includes a light source 162 and a photodetector 164. Reflectance PPG sensors are known in the art, however, the instant innovative device is not primarily a heart rate monitoring device but rather an accessory for a safety holster. Innovatively, the PPG sensor 160 provides various biometrics about the wearer. The PPG may be constantly active or may be activated at certain intervals or only at certain times. An example of the latter option is that the PPG, like the other accessories in the companion component, is only activated when an unlock signal is sent to the safety holster, or when the weapon is actually removed from the holster.

It is made clear that the PPG sensor may be incorporated into a device of the instant innovation having the simple configuration (sensing mechanism and central unit). The PPG sensor may be incorporated into any one of the aforementioned configurations which include the companion component and one or more accessories, as detailed above. The PPG sensor may be activated in any one or a combination of the activation methods detailed above for other components (even if the other components are not present).

The biometric values sensed by the PPG sensor 160 are preferably transmitted in real time to a monitoring center via the wireless component. The monitoring center may be a command center (e.g., a police command center) that also receives live video and/or audio from the camera and/or microphone if such accessories are present. The biometric data, and for that matter any audio/visual data and/or data regarding the condition of the safety holster (locked, unlocked, weapon withdrawn, weapon re-holstered), can be transmitted to a remote location or third party (e.g., command center) via the wireless component 1102.

It is clear that in order for the wireless component to provide the functionality of long-range transmission (including receiving signals from non-local sources, not just transmitting to these locations), the wireless component must include wide-area wireless communications capabilities itself or be able to piggy-back/utilize such capabilities of a nearby communications device (e.g., the user's smart phone, the communications suite of the user's patrol car, etc.). In any of the aforementioned configurations and embodiments, the wireless component may enable one- or two-way communication with remote location.

Exemplary Locking Holster

One example of a prior art locking holster that locks a weapon inside the is disclosed in U.S. Pat. No. 9,784,515 B2 to Haimi and described hereafter. FIGS. 11A-11H illustrate various views of a prior art safety holster. A safety holster 11.100 is provided for use with a weapon. The weapon having a barrel, a slide, a trigger guard, a trigger, an ejection port, a hammer end and a handle. The holster includes a holster body that includes an outer wall 11.102, a strap-side wall 11.104, a contoured top wall 11.106, and an under wall 11.108. The spaced apart strap-side and outer-side substantially rigid sidewalls define an inner cavity and an open handle-end portion for receiving a weapon therein, and for removing the weapon there from. The holster body has a long axis parallel with the barrel of the weapon when secured in the holster body. A belt-strap member 11.112 is affixed to the strap-side wall 11.104.

Further, there is a trigger-guard enclosure 11.110 that includes at least spaced apart strap-side and outer-side substantially rigid sidewalls formed to define an inner cavity. The holster has an electronically actuated locking mechanism configured to admit the weapon into the safety holster, and to engage a feature of the weapon, thereby preventing the withdrawal of the weapon prior to release of the electronically actuated locking mechanism. The electronically actuated locking mechanism actuated by an external device, such as the instant wrist-worn device 100. Exemplary holster 11.100 includes a power and/or data connector 11.130 as well as a micro USB port 11.132 which is adapted to receive data and/or power via a wired means.

The safety holster provides for insertion of the weapon into the holster body, with the locking mechanism which admits the weapon during insertion, and which engages the weapon feature (e.g., trigger guard or picatinny rail) for retention of the weapon in a locked state until the locking mechanism is disengaged by receiving an unlock signal from the external device such as device 100.

Figure 12:
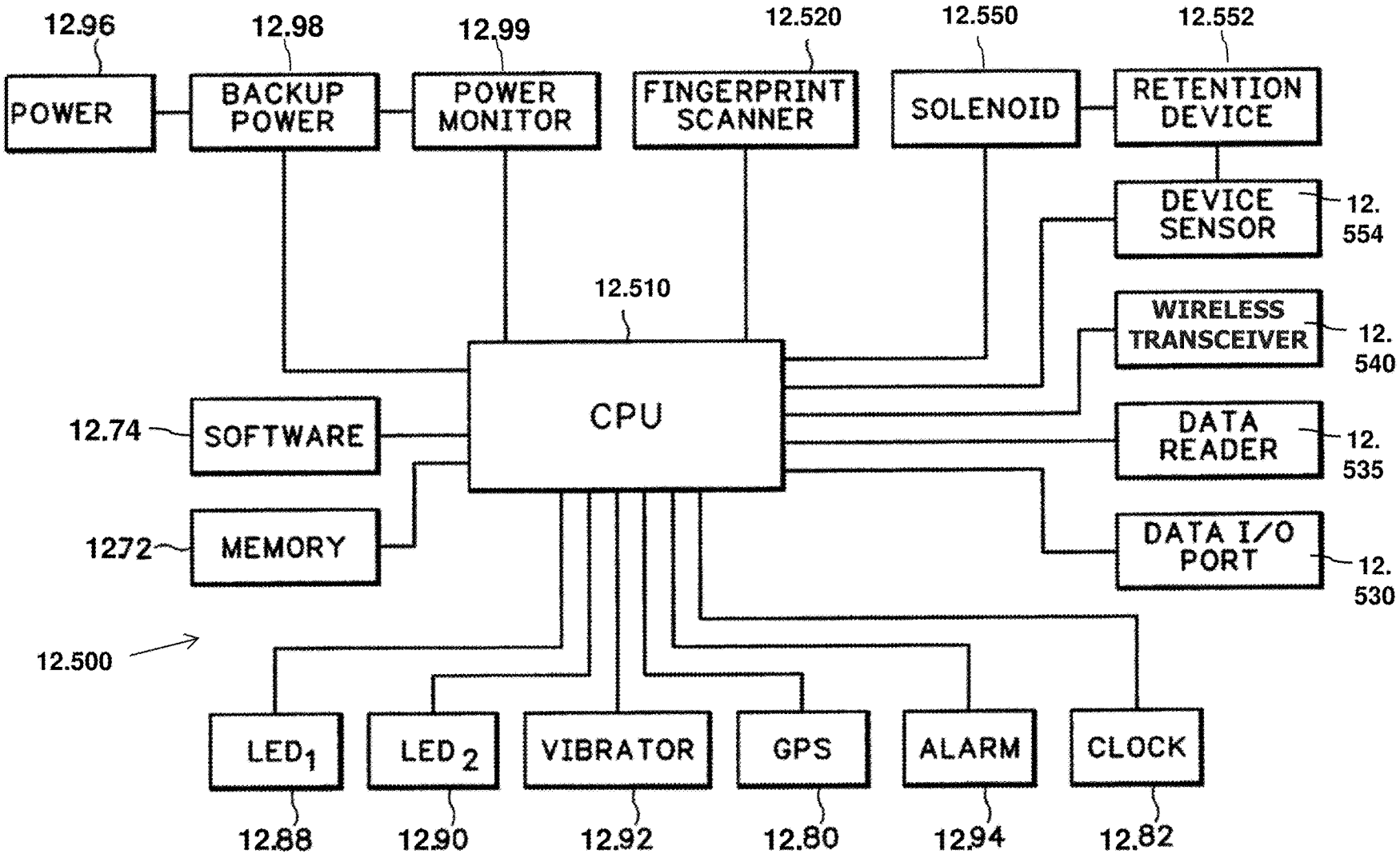
FIG. 12 PRIOR ART
FIG. 12 is a prior art control system 12.500 of the safety holster.

FIG. 12 illustrates a prior art control system 12.500 of the safety holster 11.100. The control system 12.500 includes a microprocessor (CPU) 12.510 which is configured used to receive signals from integrated components. One optional component is an integrated biometric device 520, such as a fingerprint scanning device. The CPU 510 receives and interprets the unlock signal from an external device via a wireless transceiver 12.540. The control system 12.500 is adapted to actuate the electronically actuated locking mechanism upon receipt of the unlock signal. Likewise, the control system, in relevant embodiments discussed above, provides feedback to the wrist-worn device via wireless transceiver 12.540.

The control system has a memory 12.72, such as an Electronically Erasable Programmable Read Only Memory (EEPROM), as well as software 12.74 which is connected to the microprocessor 12.510. Exemplarily, the microprocessor is connected to a solenoid 12.550, a retention device 12.552 and a device sensor 12.554 so that when it receives the appropriate signal from the microprocessor, power is provided to the solenoid 12.550 of the retention device 12.554 from power unit 12.96 to unlock the holster (which has a normally-locked state). The weapon can now be withdrawn from the holster. The device sensor registers when the weapon is returned to the holster, which is then returned to the normal, locked state. Optionally, the control system may have a backup power unit 12.98 and/or power monitor 12.99.

Exemplarily, the control system may include a Global Positioning System (GPS) 12.80 to determine the geographical location of the holster. The holster may also optionally include a clock 12.82, one or more LEDs, such as LEDs 12.88 and 12.90, a vibrator 12.92, an alarm mechanism 12.94, a switch 12.42 and/or strain gauge 12.78. The control system 12.500 includes a data I/O port 12.530 and data reader 12.535.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A wrist device for unlocking a safety holster for use with a weapon, the holster includes an electronically actuated locking mechanism configured to admit the weapon into the safety holster, and to lock the holster, thereby preventing the withdrawal of the weapon prior to release of the electronically actuated locking mechanism upon receipt of an unlock signal, the wrist device comprising:

a wearable band, adapted to be worn on a forearm;

a sensing mechanism operationally coupled to the wearable band and adapted to be actuated as a result of a predefined actuation movement of a hand or forearm wearing the wrist device;

a wireless communications component configured to send the unlock signal when said sensing mechanism is actuated; and a processing unit in electrical communication with said sensing mechanism and said wireless communications component, wherein said sensing mechanism is adapted to sense proximity or contact with another object; and wherein said sensing mechanism includes a mechanically actuated sensor.

2. The wrist device of claim 1, wherein said sensing mechanism is located on said wearable band in a location which, when the wrist device is worn on said forearm, abuts an anterior side of said forearm.

3. The device of claim 1, wherein said sensing mechanism is an electro-mechanical mechanism including:

a spring-loaded button biased to an extended state by a spring, a first contact located on an inner face of said spring-loaded button, and a second contact spaced apart from said first contact by said spring, wherein said electro-mechanical sensing mechanism is actuated when said first contact closes an electrical circuit by coming into contact with said second contact.

4. The wrist device of claim 1, wherein said sensing mechanism includes at least one sensor selected from the group including: an optical sensor, an electro-optical sensor, a touch sensor, a proximity sensor, a gyroscope and an accelerometer.

5. The wrist device of claim 1, wherein said sensing mechanism includes one of: an NFC tag and a wireless communication component calibrated to sense touch or close proximity to an object or surface.

6. The wrist device of claim 1, wherein said sensing mechanism is actuated by a hand gesture of said hand wearing the wrist device.

7. The wrist device of claim 1, further including a feedback module for providing biofeedback including a means of tactile output.

8. The wrist device of claim 7, wherein said feedback module further includes at least one of: a visual component and an audio component.

9. The wrist device of claim 1, further comprising a companion component in electrical communication with said processing unit and is located on said wearable band in a location which, when the wrist device is worn on said forearm, abuts a posterior side of said forearm.

10. The wrist device of claim 9, wherein said companion component includes: a light, said light configured to be activated when the unlock signal is sent.

11. The wrist device of claim 9, wherein said companion component includes a camera, said camera adapted to have a line of sight (LOS) parallel to a LOS of the weapon when held in said hand wearing the wrist device, and wherein said camera configured to be activated when said unlock signal is sent.

12. The wrist device of claim 9, wherein said companion component includes one or more accessories, said one or more accessories being activated in a manner selected from the group including: actuation of said sensing mechanism, actuation of said sensing mechanism more than once within a predefined time, actuation of said sensing mechanism by a predefined actuation movement or gesture, and upon receipt of a feedback signal indicating that the weapon has been unholstered.

13. The wrist device of claim 12, wherein said one or more accessories are selected from the group including: a light, a camera, a microphone, a laser sight.

14. The wrist device of claim 1, wherein said companion component includes a microphone, said microphone configured to be activated when said unlock signal is sent.

15. The wrist device of claim 1, wherein said companion component includes a laser sight, said laser sight configured to be activated when said unlock signal is sent.

16. The wrist device of claim 1, further comprising a reflectance photo-plethysmographic (PPG) sensor including a light source and a photodetector located on said wearable band such that when worn said light source and photodetector abut an anterior side of said forearm.

* * * * *